US006216577B1

(12) United States Patent
Lira-Núnez et al.

(10) Patent No.: US 6,216,577 B1
(45) Date of Patent: Apr. 17, 2001

(54) GUIDED CUTTING SYSTEM

(75) Inventors: Carmen Lira-Núnez; Erhua Cai; James W. Reardon, all of St. Cloud, MN (US)

(73) Assignee: The Antioch Company, St. Cloud, MN (US)

( * ) Notice: Subject to any disclaimer, the term of this patent is extended or adjusted under 35 U.S.C. 154(b) by 0 days.

(21) Appl. No.: 09/310,269

(22) Filed: May 12, 1999

(51) Int. Cl.[7] ..... B26D 5/00; B26B 29/00

(52) U.S. Cl. ..... 83/745; 83/544; 30/151; 30/294

(58) Field of Search ..... 30/294, 266, 290, 30/295, 310, 319, 151; D8/98, 99, 51, 14; 83/565, 745, 544

(56) References Cited

U.S. PATENT DOCUMENTS

| | | | |
|---|---|---|---|
| D. 209,420 | 11/1967 | Snyder | D8/98 |
| 312,043 | 2/1885 | Van Horn | 30/292 |
| D. 388,305 | 12/1997 | Schulz et al. | D8/98 |
| D. 392,537 | 3/1998 | Schulz et al. | D8/98 |
| 658,710 | 9/1900 | Forker | 83/565 |
| 660,211 | 10/1900 | Durkel | 30/310 |
| 701,828 | 6/1902 | Arnold | 30/310 |
| 705,576 | 7/1902 | Forker | 83/565 |
| 742,047 | 10/1903 | Moehle | 33/27.12 |
| 821,681 | 5/1906 | Vandermark | 30/292 |
| 881,899 | 3/1908 | Chapman | 33/27.12 |
| 1,358,973 | 11/1920 | Minarcik | 30/286 |
| 1,511,016 | 10/1924 | Barker | 83/483 |
| 1,528,315 | 3/1925 | Barr et al. | 33/772 |
| 1,775,813 | 9/1930 | Colby | 30/317 |
| 2,045,586 | 6/1936 | Crowley | 33/27.12 |
| 2,073,855 | 3/1937 | Steinmetz | 30/294 |
| 2,091,337 | 8/1937 | Sahl | 30/296.1 |
| 2,209,751 | 7/1940 | Wulff | 30/156 |
| 2,307,424 | 1/1943 | Savage | 30/277.4 |
| 2,383,208 | 8/1945 | Mustered | 33/27.12 |
| 2,448,878 | 9/1948 | Fuller | 33/27.12 |
| 2,449,702 | 9/1948 | Iwerks | 352/87 |
| 2,548,698 | 4/1951 | Benge | 83/410 |
| 2,608,800 | 9/1952 | Ritter | 451/38 |
| 2,612,689 | 10/1952 | Kirkman et al. | 33/27.12 |
| 2,714,890 | 8/1955 | Vang | 606/169 |
| 3,026,617 | 3/1962 | Jendrisak | 33/27.12 |
| 3,180,380 | 4/1965 | Franzen | 83/875 |
| 3,456,346 | 7/1969 | Snyder | 30/310 |

(List continued on next page.)

*Primary Examiner*—Kenneth E. Peterson
*Assistant Examiner*—Stephen Choi
(74) *Attorney, Agent, or Firm*—Biebel & French

(57) ABSTRACT

A guided cutting system including first and second blade cartridges which are used in association with templates. The blade cartridges each include a head portion and cover portion wherein the head portion includes a non-use end and a cutting end. The cutting end includes a pair of guide pegs and a cutting blade wherein the guide pegs are adapted to be received within a peripheral groove formed on a template. The cover portion is adapted to be attached to the non-use end of the head portion whereby the cover portion acts as a handle for guiding the head portion during a cutting operation. Alternatively, the head portion may be attached over the cutting end of the head portion to cover and prevent contact with the cutting blade. A different spacing is provided between the cutting blade and guide pegs for the first and second head portions whereby one head portion may be used for cropping a photograph and the other head portion may be used for cutting a corresponding backing mat for the photograph. In addition, the templates for use with the blade cartridges may be designed with a predetermined outer periphery and an inner periphery extending around an open interior area of the template wherein guide grooves for the guide pegs are provided adjacent to the exterior periphery and the interior periphery for guiding the blade cartridges along exterior and interior guide paths.

9 Claims, 11 Drawing Sheets

U.S. PATENT DOCUMENTS

| | | | | |
|---|---|---|---|---|
| 3,621,574 | | 11/1971 | Yanke et al. | 30/280 |
| 3,768,347 | | 10/1973 | Wade et al. | 83/471.2 |
| 3,802,080 | | 4/1974 | Peter | 30/377 |
| 3,886,656 | | 6/1975 | Meshulam et al. | 30/164.9 |
| 3,977,077 | | 8/1976 | Rebold | 30/151 |
| 4,020,550 | | 5/1977 | Okada | 30/124 |
| 4,028,802 | | 6/1977 | Houghton et al. | 30/294 |
| 4,050,336 | | 9/1977 | Stubbings | 83/486.1 |
| 4,062,116 | | 12/1977 | Arnott | 30/292 |
| 4,102,591 | | 7/1978 | Alcorn | 407/100 |
| 4,112,793 | | 9/1978 | Pierce | 82/1.3 |
| 4,176,452 | | 12/1979 | Duggins et al. | 30/293 |
| 4,233,736 | | 11/1980 | Duggins et al. | 30/293 |
| 4,260,300 | | 4/1981 | Pickhardt | 408/1 R |
| 4,589,207 | * | 5/1986 | Loth et al. | 30/294 |
| 4,593,467 | | 6/1986 | Safar | 30/300 |
| 4,624,057 | | 11/1986 | Hursey | 33/570 |
| 4,635,369 | | 1/1987 | Powell | 33/27.11 |
| 4,672,964 | | 6/1987 | Dee et al. | 606/170 |
| 4,782,730 | | 11/1988 | Picone et al. | 83/745 |
| 4,790,222 | | 12/1988 | Morgan | 82/1.3 |
| 5,022,577 | | 6/1991 | Fike | 225/47 |
| 5,055,106 | | 10/1991 | Lundgren | 606/167 |
| 5,065,517 | | 11/1991 | Markes | 30/300 |
| 5,079,843 | * | 1/1992 | Shelton et al. | 30/310 |
| 5,101,564 | | 4/1992 | Melter | 30/319 |
| 5,233,748 | | 8/1993 | Logan et al. | 30/310 |
| 5,299,355 | | 4/1994 | Boda et al. | 30/162 |
| 5,355,588 | | 10/1994 | Brandenburg, Jr. et al. | 30/319 |
| 5,428,898 | | 7/1995 | Hawkins | 30/295 |
| 5,501,015 | | 3/1996 | Harvey | 30/164.9 |
| 5,526,573 | | 6/1996 | Peters et al. | 33/31 |
| 5,555,631 | | 9/1996 | Houston | 33/31 |
| 5,649,365 | | 7/1997 | Yang | 30/319 |
| 5,711,077 | | 1/1998 | Schulz et al. | 30/160 |
| 5,765,289 | | 6/1998 | Schulz et al. | 30/319 |
| 5,860,217 | | 1/1999 | Braun | 30/300 |

* cited by examiner

GUIDED CUTTING SYSTEM

BACKGROUND OF THE INVENTION

The present invention is related generally to a cutting system for cutting sheet material and, more particularly, to a guided cutting system for cutting predetermined shapes out of sheet material, such as photographs and mat material, for use in photograph scrapbooking applications.

In order to provide an attractive presentation of photos in a scrapbook, the photos are often cut or cropped, cutting away a peripheral area of the photo and leaving a central main subject portion of the photo. Cropping of photos provides an attractive border area for the photo wherein the photo may be cropped in a circular, oval or wavy peripheral edge, and additionally may be provided with a mat which underlies the photo and extends beyond the edges thereof for enhancing the framing of the picture on a scrapbook page. Typically, the mat is made such that it mirrors and extends beyond the peripheral edge of the cropped photo in order to provide a uniform edge border around the photo.

Various devices have been proposed to facilitate the cropping operation including special scissors having wavy or deckled edges, and guided cutters such as the one disclosed in U.S. Pat. No. 701,828 to Arnold which incorporates a guide plate for guiding an arm movably supported on the plate to direct a cutting blade in a desired pattern for cutting a mat. Other known guided cutting devices for cutting circles or ovals in a sheet of material include those incorporating a so called "Scottish yoke" mechanism which utilizes a base member supporting a pivoted arm and including two transversely oriented axes for guiding the arm in a controlled elliptical path. Alternatively, the arm may be held in a central location of intersection between the two paths whereby the arm may be pivoted in a circular movement. Typical examples of such devices are shown in U.S. Pat. No. 5,233,748 to Logan et al. and in U.S. Pat. No. 5,555,631 to Houston.

While the known devices for cutting ovals and circles provide the desired results of accurately following a desired shape, such devices are typically complex in that they require assembly of several parts and also are generally not well adapted to convenient storage and transportation in that they incorporate an elongated arm connected to and extending from a base, such that they are not adapted to compact storage, a desirable attribute for equipment used by those involved in scrapbooking.

Accordingly, there is a need for an apparatus which facilitates cutting of ovals, circles and other shapes in sheet material and which requires a minimum of parts with accompanying reduced cost. In addition, there is a need for such an apparatus wherein a cutter is provided having means for protecting a user from contact with a cutting portion of the cutter when it is not in use.

SUMMARY OF THE INVENTION

In accordance with the present invention, a guided cutting system is provided including first and second blade cartridges, each blade cartridge including a head portion and a cover portion detachably mountable to the head portion. In addition, a template is provided having at least one groove for guiding a selected one of the blade cartridges in a predetermined cutting path to thereby cut a predetermined pattern in a substrate underlying the template.

The head portion of each blade cartridge includes a cutting end and a non-use end, and a side wall extending between the cutting end and the non-use end. The cutting end includes a cutting blade supported within a blade holder and a pair of spaced pegs forming guide means for positioning within the groove of the template. The blade of the first blade cartridge is located a first predetermined distance from the guide pegs thereof, and the blade of the second cartridge is located a second predetermined distance from the guide pegs thereof wherein the second predetermined distance is greater than the first predetermined distance. Thus, the first blade cartridge may be used to cut a desired outline in a photo, and the second blade cartridge may be used to cut a corresponding shape in a mat wherein the size of the mat is greater than that of the photo such that the present cutting system provides a matching border for a cropped photo.

The cover portion includes a side wall defining opposing ends wherein a peripheral edge at one end defines an open end, and an end wall at an opposing end defines a closed end for the cover portion. The side wall defines an inner surface dimensioned to receive and engage the side wall of the head portion. The head portion and cover portion are configured such that the cover portion is mountable over the non-use end of the head portion to thereby define a handle portion for a person to grasp the blade cartridge and guide it around the template, and the cover portion is also mountable over the cutting end of the head portion for providing a guard to prevent contact with the cutting blade when the blade cartridge is not in use.

The template may be provided with an open interior area defined by an inner peripheral edge wherein a first groove is provided adjacent to an outer peripheral edge of the template and a second groove is provided adjacent to the inner peripheral edge of the template. In this manner, a single template may be used for creating large or small cuts depending on whether the blade cartridge is guided around the outer periphery or inner periphery, respectively.

Therefore, it is an object of the present invention to provide a guided cutting system including a blade cartridge capable of being hand guided around a template.

It is a further object of the invention to provide a blade cartridge wherein a cover portion is provided for attachment to either one of two opposing ends of a blade carrying head portion.

It is yet another object of the invention to provide a guided cutting system including two similarly constructed blade cartridges adapted to be guided around a periphery of a template and to provide a predetermined size differential for a pattern being cut.

It is an additional object of the invention to provide a guided cutting system wherein a template is provided having an open interior area and including outer and inner peripheral grooves to guide a blade cartridge to cut different size patterns.

Other objects and advantages of the invention will be apparent from the following description and the accompanying drawings.

DETAILED DESCRIPTION OF THE PREFERRED EMBODIMENT

Figure 1:
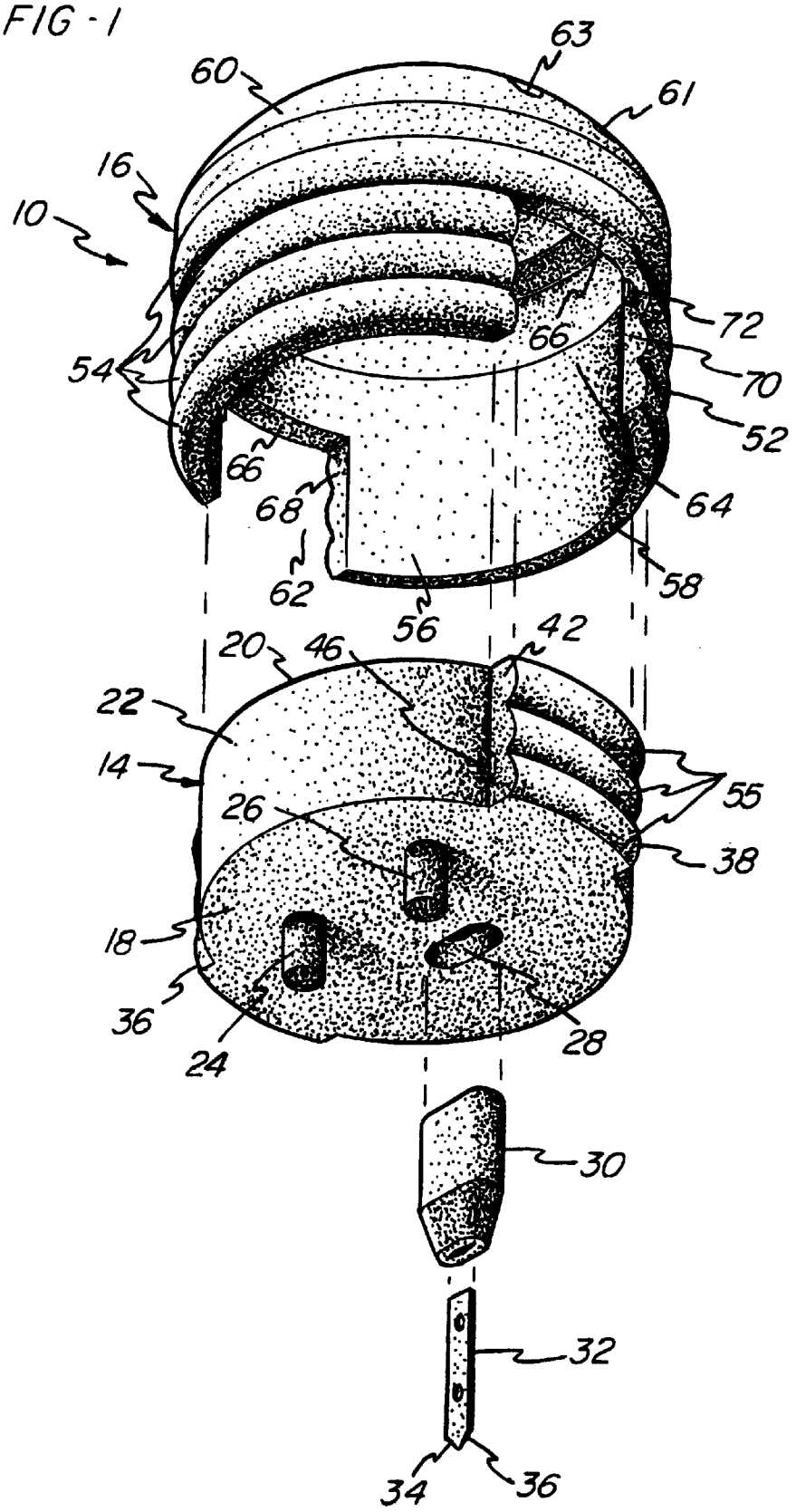
FIG. 1 is an exploded perspective view of a first blade cartridge for the guided cutting system of the present invention.
Figure 2:
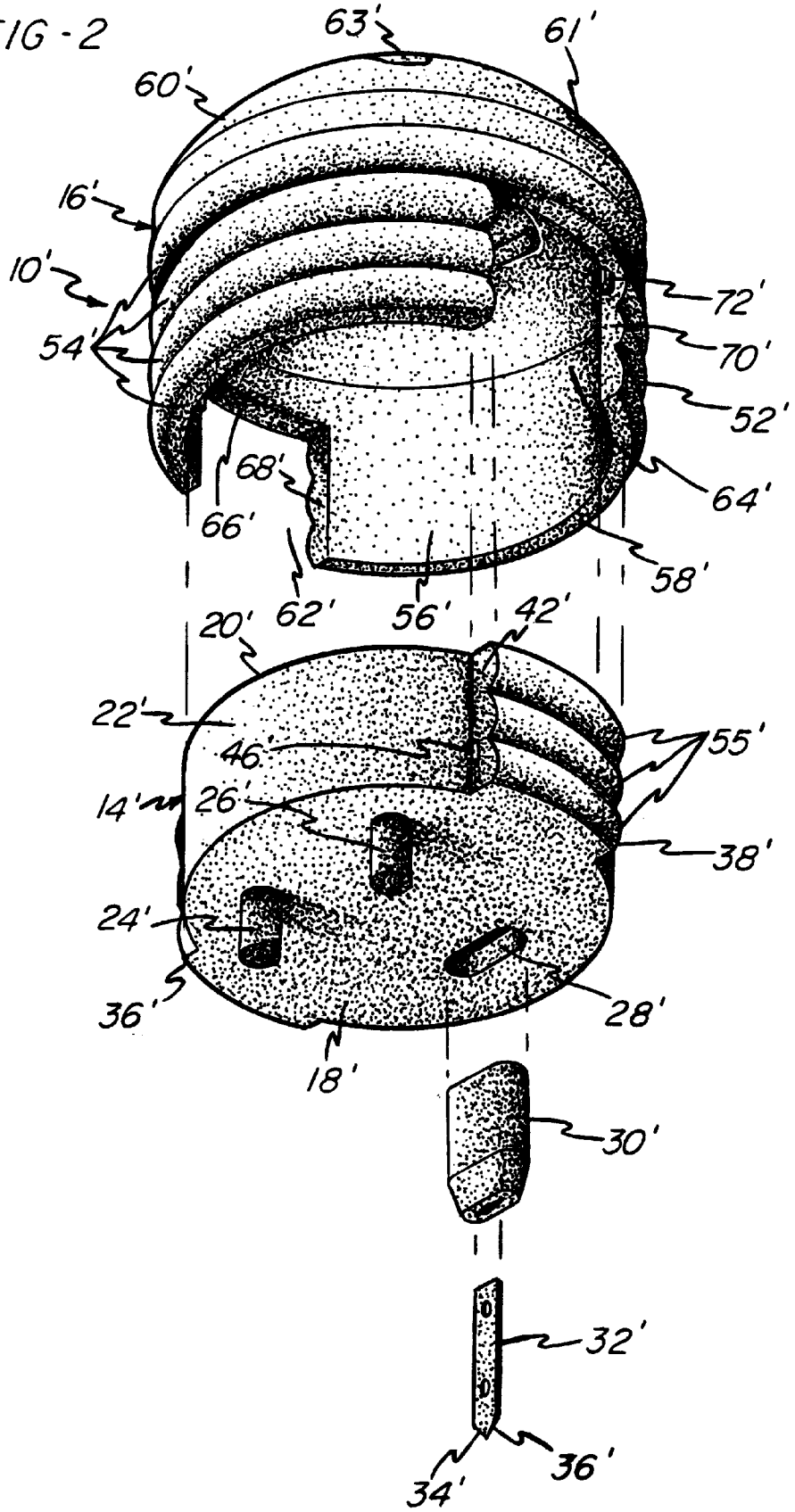
FIG. 2 is an exploded perspective view of a second blade cartridge for the guided cutting system of the present invention.
Figure 12:
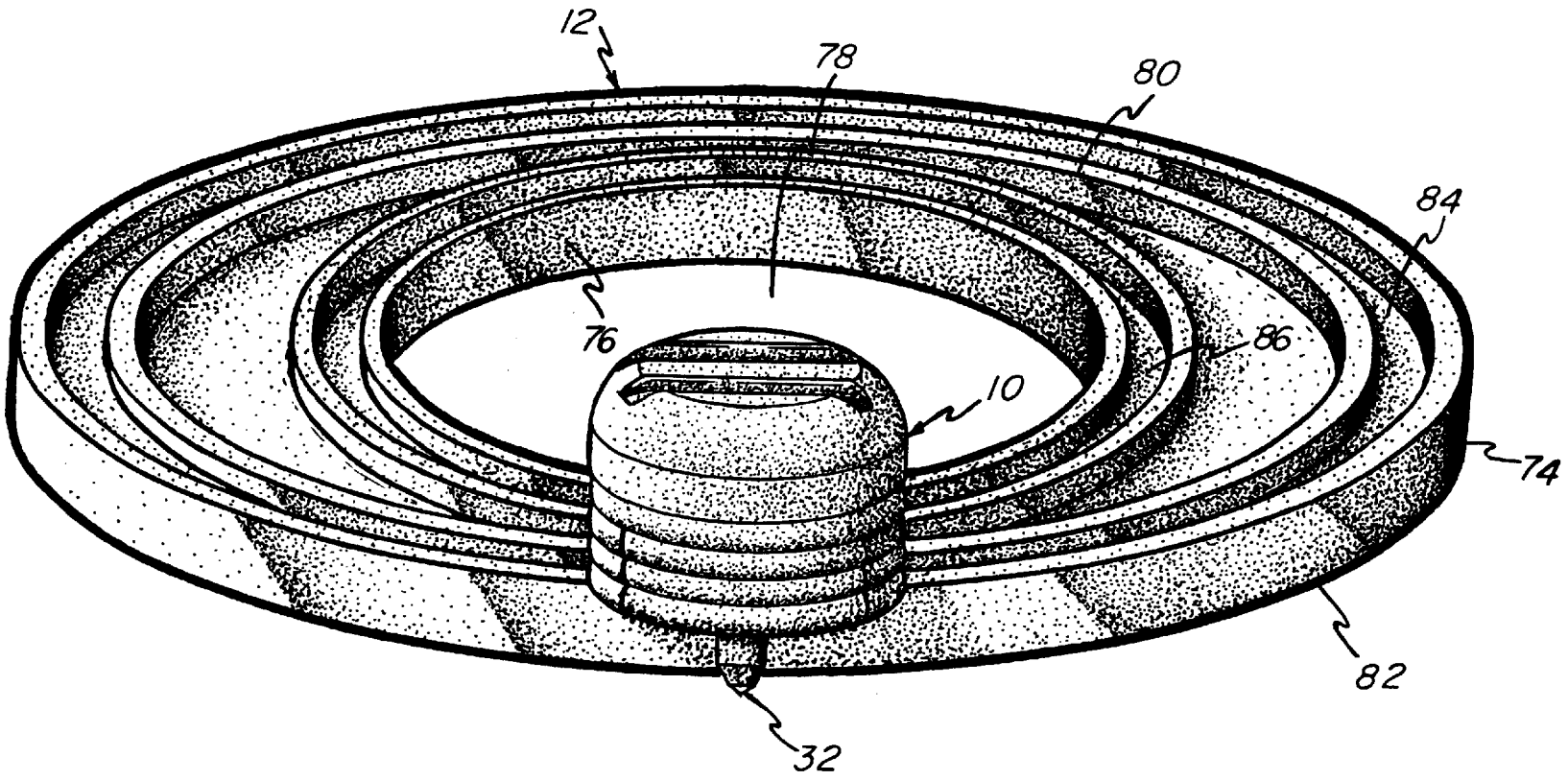
FIG. 12 is a perspective view of the first blade cartridge in position for use along an outer peripheral path of an oval template.

Referring to FIGS. 1, 2 and 12, the guided cutting system of the present invention includes first and second blade cartridges 10 and 10', respectively, and a template 12 for guiding the plate cartridges 10, 10' in a predetermined cutting path. The first and second blade cartridges 10, 10' are formed with the same structural elements which will be described with particular reference to the first blade cartridge 10 wherein the elements of the second blade cartridge 10' corresponding to the first blade cartridge are labeled throughout the drawings with the same reference numeral primed, and only differences between the first and second blade cartridges 10, 10' are specifically described in the following description.

Figure 3:
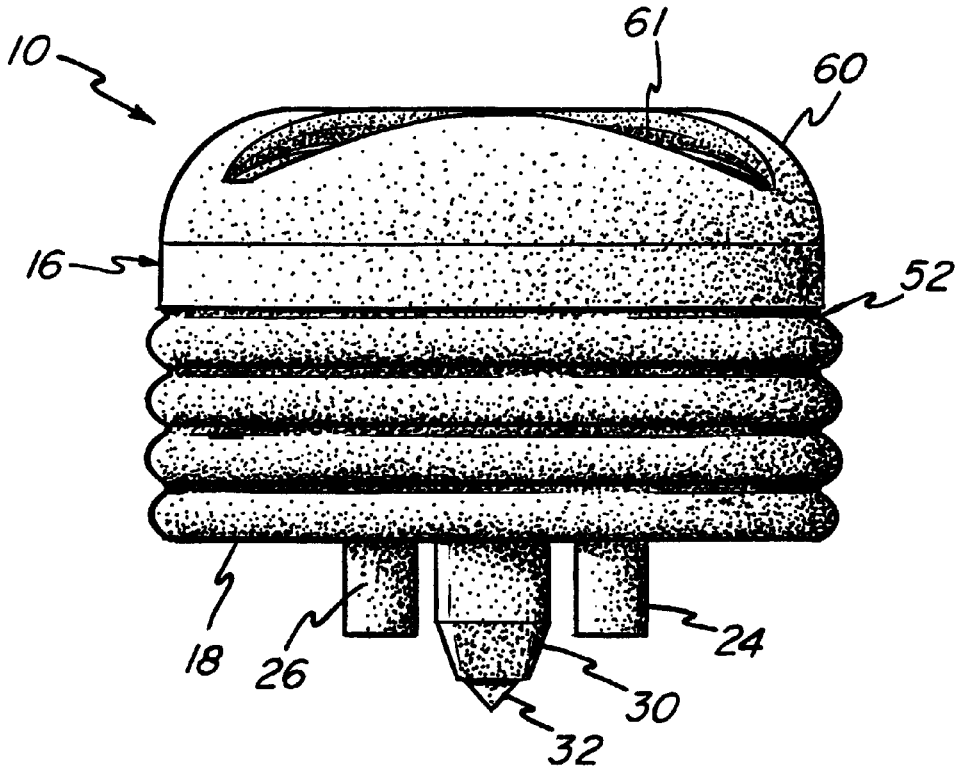
FIG. 3 is a side elevational view of the first blade cartridge in a use configuration.
Figure 4:
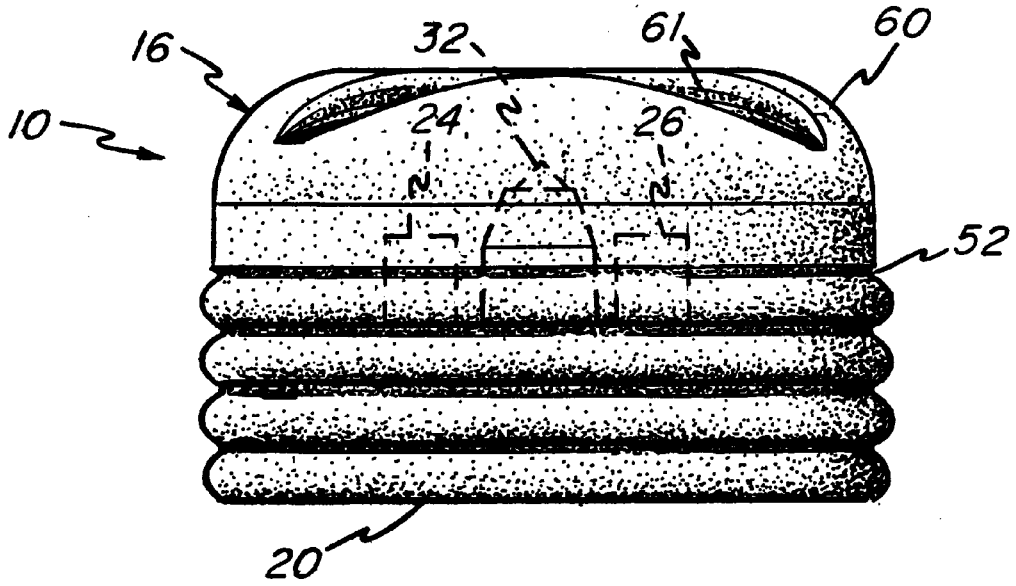
FIG. 4 is a side elevational view of the first blade cartridge in a non-use configuration.

As seen in FIGS. 1, 3 and 4 the blade cartridge 10 comprises a head portion 14 and a cover portion 16 which is configured to be detachably mounted to the head portion 14. The head portion 14 is formed with a cutting end 18 and a non-use end 20, and a generally cylindrical side wall 22 extends axially between the cutting end 18 and non-use end 20. The cutting end 18 includes a pair of spaced guide pegs 24, 26 extending axially from the surface of the cutting end 18 to define guide means for engaging the template 12 to guide the blade cartridge 10 during a cutting operation. The cutting end 18 further includes an elongated blade aperture 28 for receiving an assembly comprising a blade holder 30 and cutting blade 32 positioned within the holder 30. It should be noted that the cutting blade 32 includes a pair of cutting edges 34, 36 converging to a central point whereby the blade cartridge 10 may be directed in either one of two directions to cut a substrate underlying a template 12.

Figure 5:
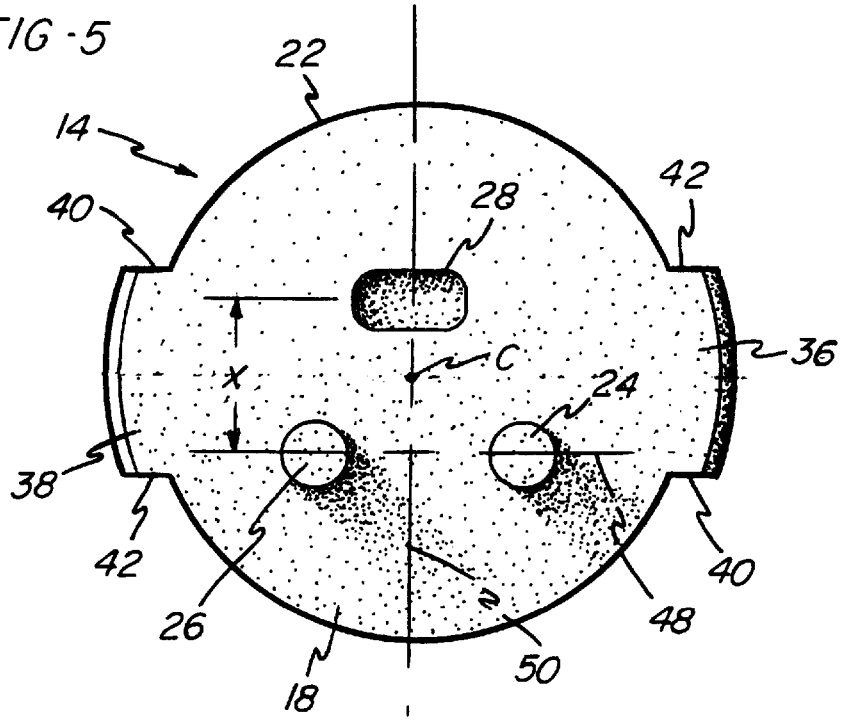
FIG. 5 is a bottom plan view of the head portion of the first blade cartridge with the cutting blade removed.
Figure 7:
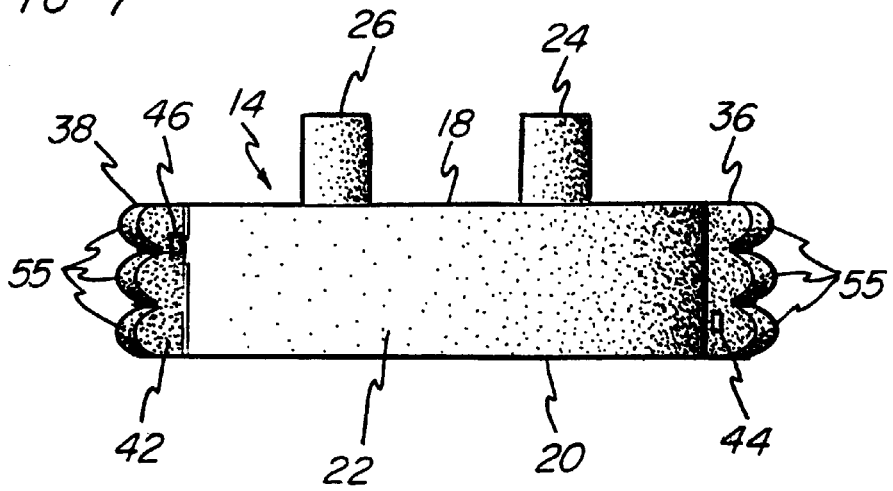
FIG. 7 is a side elevational view of the head portion of the first blade cartridge.

Referring to FIGS. 5 and 7, the cutting head 14 is shown without the blade holder 30 and blade 32 in position, and can be seen to include a pair of diametrically opposed gripping portions 36, 38 defining raised sectors extending radially outwardly from the side wall 22, each gripping portion 36, 38 including a pair of radially extending side surfaces 40, 42 and an outer surface defining ribs 55. The gripping portions 36, 38 further include opposing axial ends which are substantially contiguous with the surfaces of the cutting end 18 and non-use end 20. It should also be noted that the side walls 40 of each of the gripping portions 36, 38 include a hole or recess 44 (only one shown) located adjacent to the non-use end 20 of the head portion 14, and the side surfaces 42 of each of the gripping portions 36, 38 include a hole or recess 46 (only one shown) adjacent the cutting end 18 of the head portion 14.

As seen in FIG. 5, a line 48 passing through the guide pegs 24, 26 is located in spaced relation to a diametrical center C of the head portion 14 and is perpendicularly bisected by a bisecting line 50 passing through the diametrical center C. The blade aperture 28 is located on an opposite side of the center C of the head portion 14 from the line 48 and is intersected by and centered on the bisecting line 50. The blade 32 supported within the blade aperture 28 is supported a predetermined distance X from the guide pegs 24, 26, as measured to the line 48. The distance between the guide pegs 24, 26 and the blade 32 supported within the blade aperture 28 defines the particular predetermined distance that the blade 32 will be positioned from the edge of a guiding template 12 to thereby define the size of cut to be made on an underlying substrate.

Figure 6:
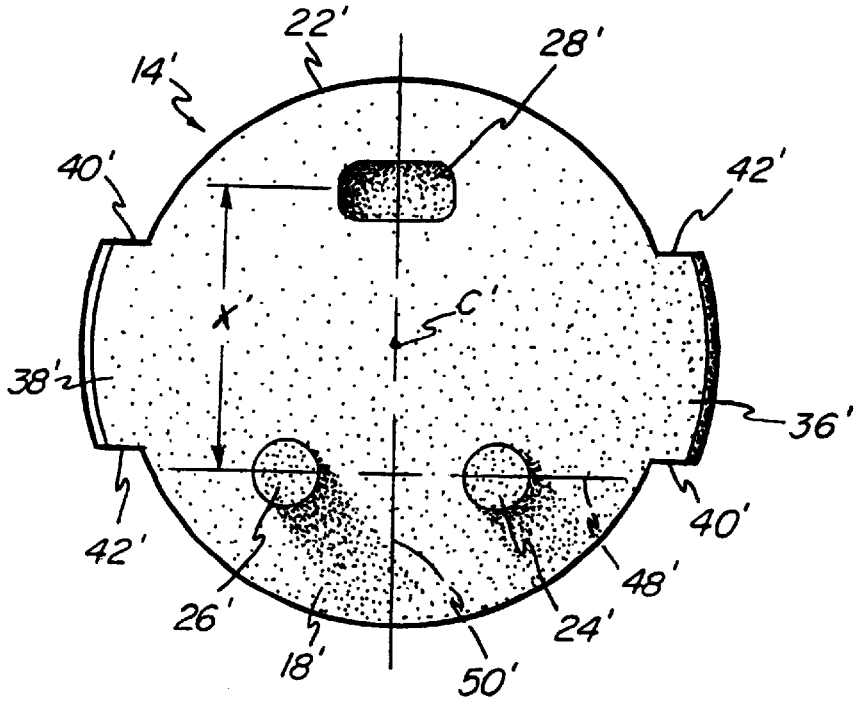
FIG. 6 is a bottom plan view of the head portion of the second blade cartridge with the cutting blade removed.

Referring further to FIG. 6, a head portion 14' for the second blade cartridge 10' is shown and differs from the first head portion 14 in that the distance X' of the blade aperture 28' from the guide pegs 24', 26' is greater than the distance X for the first head portion 14. Thus, the blade cartridge 10' incorporating the second head portion 14' will perform a cut at a second, greater predetermined distance from the edge of a template 12 used to guide the blade cartridges 10, 10'. Accordingly, the blade cartridge 10 incorporating the first head portion 14 may be guided around an outer peripheral edge of the template 12 to cut out a portion of a photograph, while the blade cartridge 10' incorporating the second head portion 14' may be used to cut out a background mat having a larger periphery than the cropped photograph.

Referring to FIGS. 8–11, the cover portion 16 includes a generally cylindrical side wall 52 including a plurality of circumferential ribs 54 which facilitate gripping the cover portion 16. The side wall 52 defines an inner surface 56 of the cover portion 16 for engaging the side wall 22 of the head portion 14.

The side wall 52 of the cover portion 16 includes a peripheral edge 58 defining an open end for the cover portion 16, and further includes an end wall 60 defining a closed end for the cover portion 16. A pair of diametrically opposed channels 62, 64 (see also FIG. 1) extend inwardly from the peripheral edge 58. Each of the channels 62, 64 includes an inner edge 66, and opposed first and second side edges 68, 70. The inner edges 66 are adapted to engage against the axial ends of the gripping portions 36, 38, and the side edges 68, 70 are adapted to engage the side surfaces 40, 42 of the head portion 14. The edges 68 each include a locking member comprising a tab 72 for engaging within the recesses 44, 46 defined in the side surfaces 40, 42 of the head portion 14 to thereby lock the cover portion 16 in position on the head portion 14.

Figure 8:
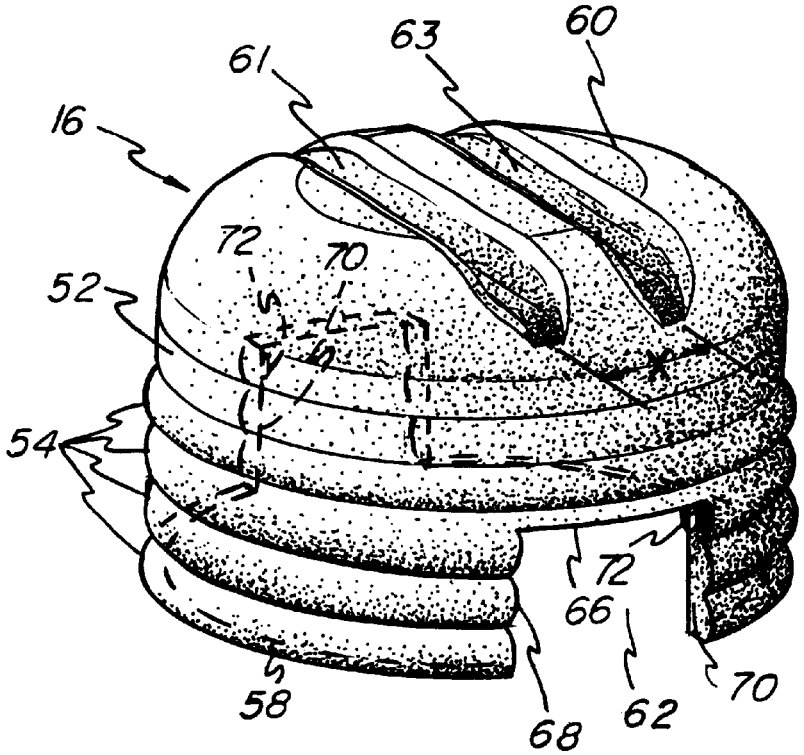
FIG. 8 is a perspective view of a cover portion for the first blade cartridge.
Figure 9:
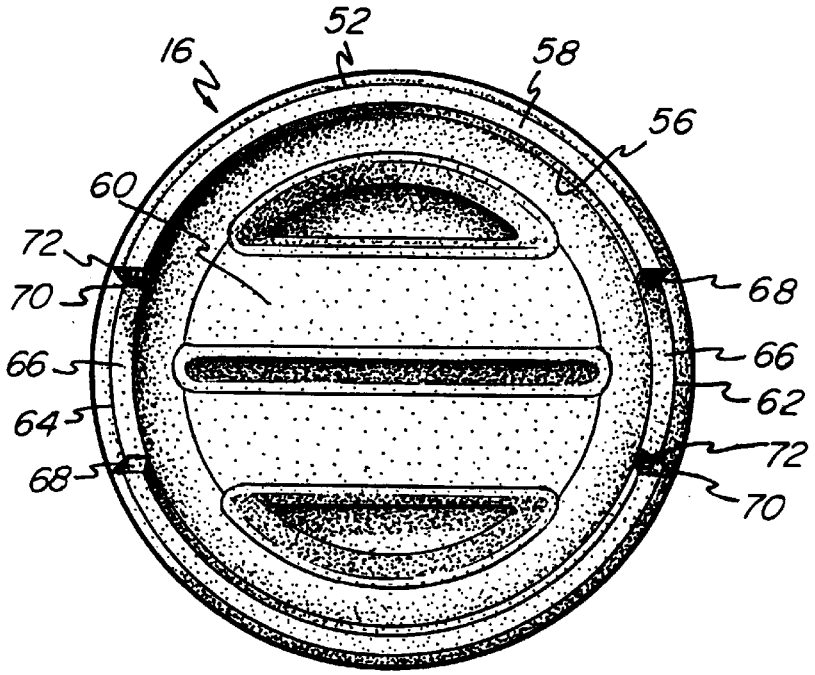
FIG. 9 is a bottom plan view of the cover portion of FIG. 8.
Figure 10:
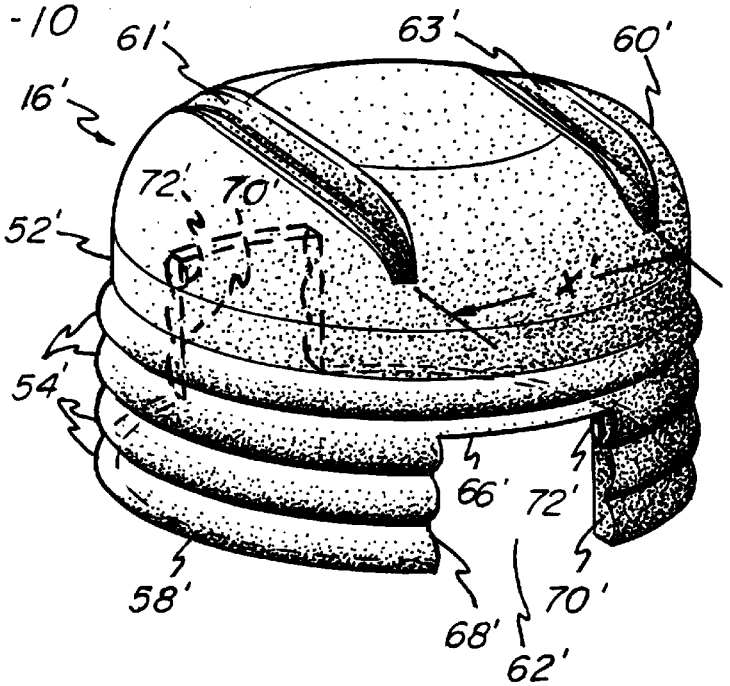
FIG. 10 is a perspective view of a cover portion for the second blade cartridge.
Figure 11:
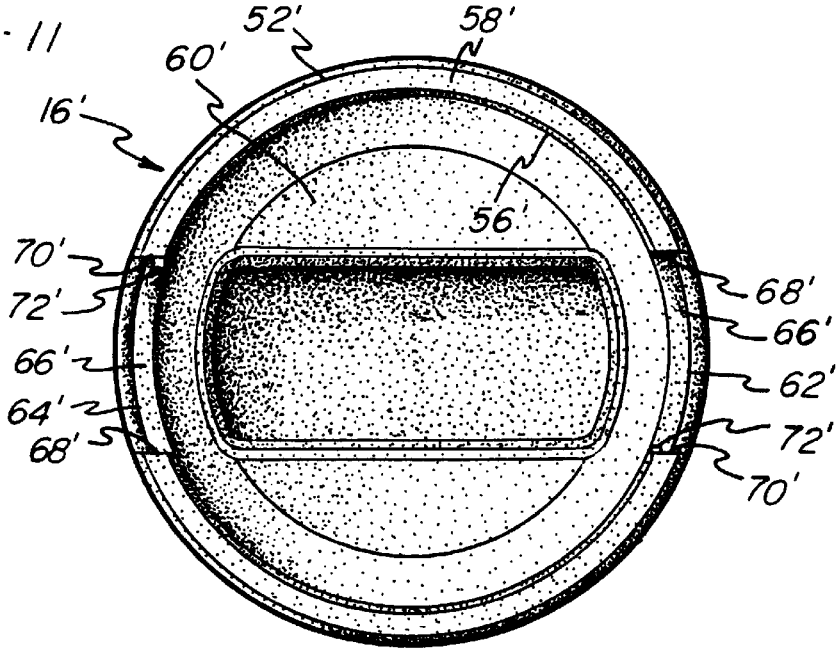
FIG. 11 is a bottom plan view of the cover portion of FIG. 10.

Referring to FIGS. 8 and 10 it should be noted that the cover positions 16, 16' used in association with the head portions 14 and 14'are substantially the same with the exception of the construction of the end walls 60 and 60'. In particular, as seen in FIG. 8, the end wall 60 of the cap 16 includes a pair of spaced, elongated grooves 61, 63 wherein the grooves 61, 63 are spaced apart the distance X corresponding to the spacing between the blade 32 and the guide pegs 24, 26. Thus, the grooves 61, 63 provide an indication for the user as to the cutting distance provided between the guide pegs 24, 26 and the cutting blade 32 to thereby facilitate selection and use of the blade cartridge 10.

Similarly, the cover portion 16' shown in FIG. 10 includes a pair of spaced, elongated grooves 61', 63'. The grooves 61', 63' are spaced apart a distance X' corresponding to the distance X' between the blade 32' and guide pegs 24', 26' of the second head portion 14' . As with the first cover portion 16, the grooves 61', 63' on the second cover portion 16' provide an indication to a user to facilitate selection and use of the second blade cartridge 10'.

Figure 13:
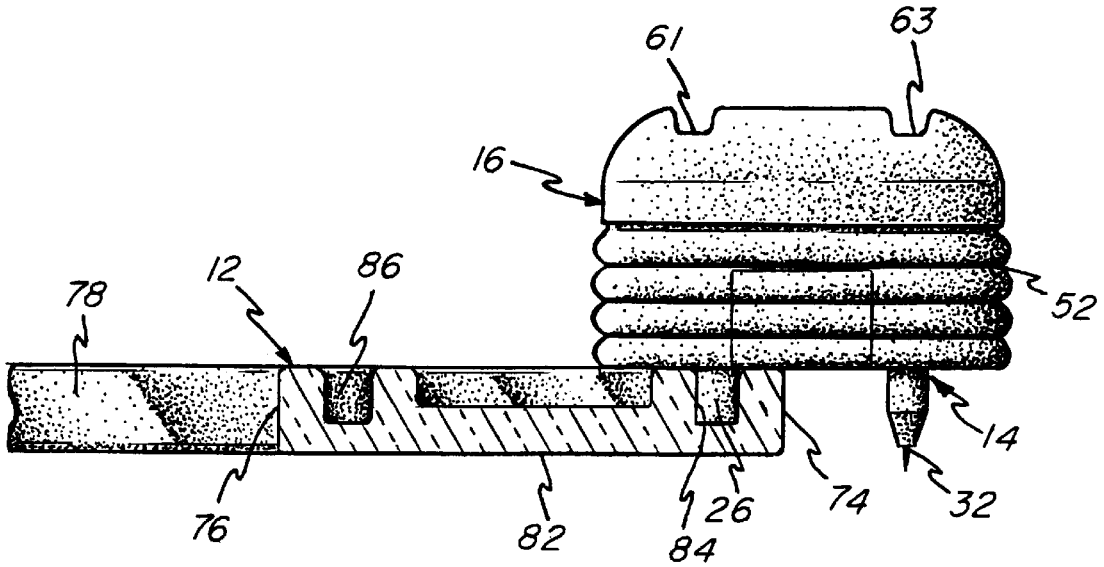
FIG. 13 is a cross-sectional view of the template of FIG. 12.

Referring to FIGS. 12 and 13, the blade cartridge 10 is shown in use with an oval template 12. The template 12 is formed as a substantially planar member having an outer peripheral edge 74 and an inner peripheral edge 76 defining an open interior area 78.

The template 12 further includes an upper surface 80 and a lower surface 82 wherein the upper surface 80 includes a first groove 84 adjacent to and spaced inwardly from the outer peripheral edge 74, and a second groove 86 adjacent to and spaced outwardly from the inner peripheral edge 76. The first groove 84 defines a first predetermined cutting path for guiding the blade cartridge 10 around the outer periphery of the template 12, and the second groove 86 defines a second predetermined path for guiding the blade cartridge 10 within the open interior area 78 of the template 12.

As best seen in FIG. 13, the spaced pegs 24, 26 are engaged within the groove 84 to guide the blade cartridge 10 around the outside of the template 12 in a first predetermined oval cutting path. In this use of the cutting system of the present invention, the blade cartridge 10 incorporating the first head portion 14 may be guided along the first cutting path 84 to cut out a desired portion of a photograph, and the blade cartridge 10' incorporating the second head portion 14' may be guided along the first cutting path 84 to cut out a mat portion of a larger size for use with the cropped photograph.

Alternatively, the blade cartridges 10, 10' may be guided around the interior oval path defined by the groove 86. In this use of the blade cartridges 10, 10' the blade cartridge 10' would be used to crop the photograph, while the blade cartridge 10 would be used to create the mat for use with the cropped photograph.

Figure 15:
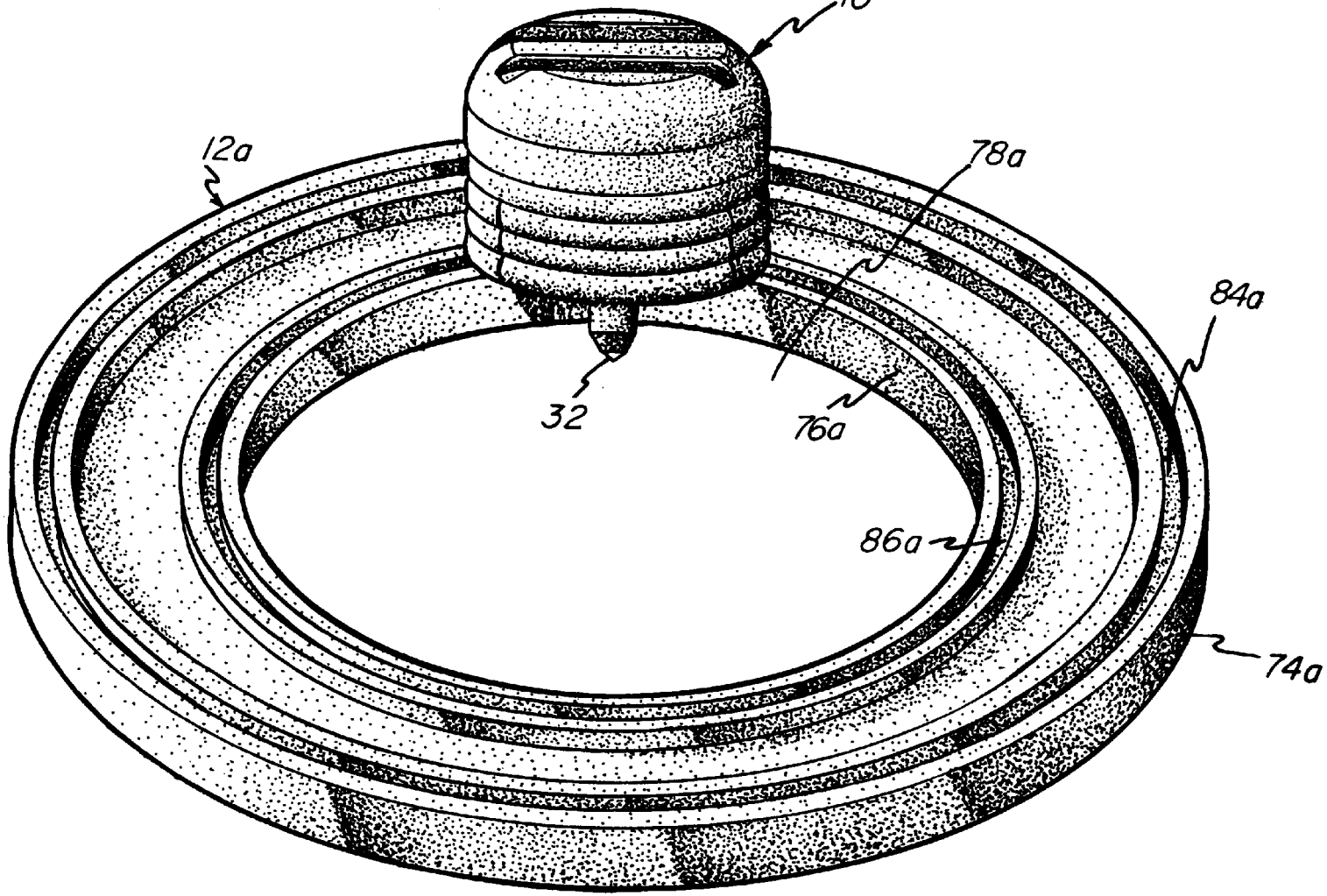
FIG. 15 is a perspective view of the first blade cartridge in position for use along an inner peripheral path of a circular template.

Referring to FIG. 15, a circular template 12*a* is illustrated including a first groove 84*a* located adjacent an outer peripheral edge 74*a*, and includes a second groove 86*a* located adjacent an inner peripheral edge 76*a* defining an open interior area 78*a*. Further, the blade cartridge 10 is illustrated in position on the second groove 86*a* for following a cutting path defined within the open interior area 78*a*.

Figure 16:
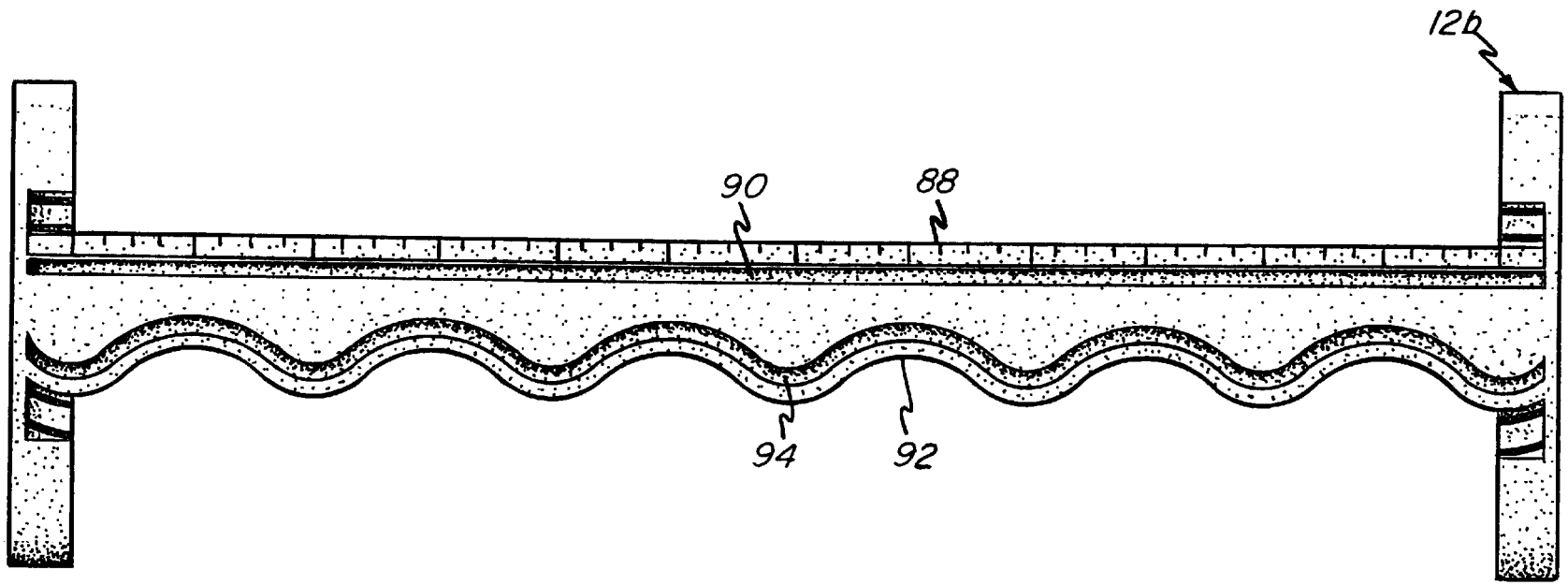
FIG. 16 is a plan view of an alternative template for cutting straight and wavy edges.

Referring further to FIG. 16, an additional template 12*b* is illustrated for use with the blade cartridges 10, 10' of the present invention. In this embodiment of the template, the template 12*b* is provided with a straight edge 88 having a straight groove 90 located adjacent thereto for guiding a blade cartridges 10, 10' . An opposing edge 92 defines a wavy shape and includes a corresponding wavy groove 94 for guiding a blade cartridges 10, 10'. In addition, it should be understood that a wide variety of other guide shapes may be provided for guiding the blade cartridges 10, 10' of the present invention.

Figure 14:
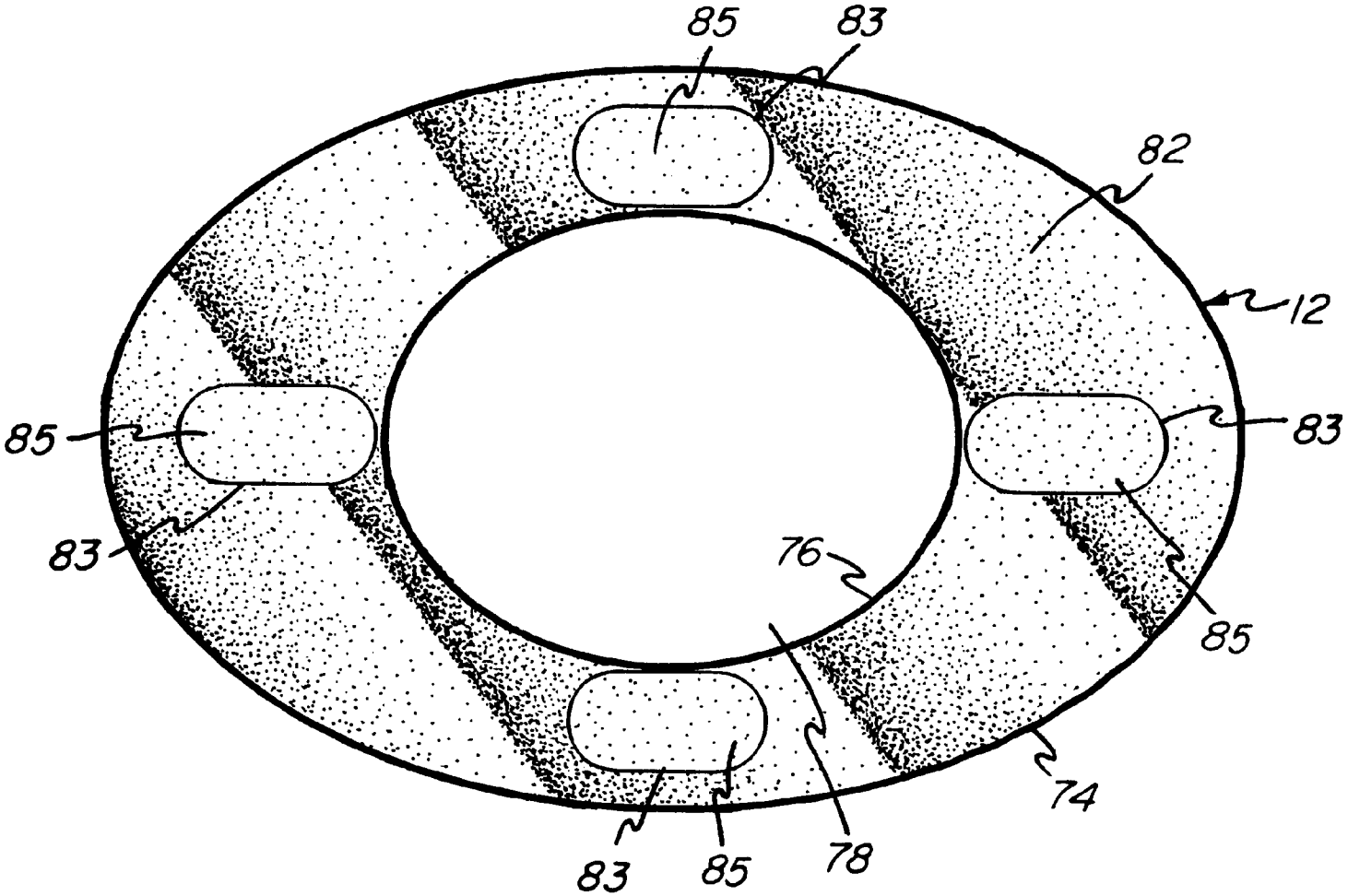
FIG. 14 is a bottom plan view of the template of FIG. 12.

Referring to FIG. 14, the bottom surface 82 of the template of FIGS. 12 and 13 is shown and includes discrete recessed areas 83 within which feet or pads of non-slip material 85 are placed. For example, in the preferred embodiment, the template 12 is formed of a polycarbonate material which will permit the blade cartridges 10, 10' to easily slide across the upper surface 80 of the template 12. The pads 85 are preferably formed of a second, non-slip material, such as polyurethane, which will ensure that the template 12 will not slip relative to a substrate surface such as a picture or mat being cut. In addition, the pads 85 are strategically placed at four equally spaced circumferential locations, 90° from each other, to minimize the amount of non-slip material 85 required while providing the template with sufficient non-slip material 85 to ensure that it will function as desired for any cutting operation in accordance with the design of the template 12.

Further, it should be understood that the templates 12*a* and 12*b* shown in FIGS. 15 and 16 are provided with a similar non-slip material. It should also be noted that the template shown in FIG. 15 is provided with pads 85 at four equally spaced circumferential locations, in a manner similar to that shown for the template shown in FIG. 14.

From the above description it should be apparent that the cover portion 16 of the present invention performs a dual function in combination with the head portion 14, in that the cover portion 16 operates as both a handle for guiding the cutting action performed by the head portion 14 when the cover portion 16 is mounted to the head portion 14 in a use position, and as a safety cover over the cutting blade 32 when the cover portion 16 is in a non-use position on the head portion 14. In the use position of the cover portion 16, the cover portion 16 is mounted over the end 22 of the head portion 14 with the gripping portions 36, 38 located within the channels 62, 64, and the tabs 72 of the cover portion 16 engaged within the recesses 44 to positively hold the cover portion 16 in place on the head portion 14.

Alternatively, in the non-use position of the cover portion 16, the cover portion 16 is positioned over the end 18 of the head portion 14 with the gripping portions 36, 38 engaged within the channels 62, 64. In this position of the cover portion 16, the tabs 72 of the cover portion 16 are engaged with the recesses 46 adjacent the end 18 of the head portion 14 to thereby positively lock the cover portion 16 in place over the head portion 14.

It should further be noted that by providing the ribs 54 around the cover portion 16, and by providing corresponding ribs 55 on the gripping portions 36, 38, the blade cartridge 10 is provided with a convenient gripping surface for facilitating gripping of the blade cartridge 10 in a cutting operation. In addition, the ribs 54, 55 facilitate grasping the cover portion 16 and head portion 14 when a user desires to separate these two portions in order to change the position of the cover portion 16 relative to the ends 18 and 20 of the head portion 14.

Thus, the blade cartridge of the present invention provides a simple structure in which a cover portion 16 for the blade cartridge performs a dual function of forming a handle during use of the blade cartridge and forming a safety cover for preventing contact with the blade of the blade cartridge when it is not in use.

In addition, the present invention advantageously provides a set of first and second blade cartridges wherein the cartridges are usable with guide templates and provide different predetermined cutting perimeters whereby one blade cartridge may provide a cropped photo and the other blade cartridge may provide a mat for the cropped photo. Also, different templates may be provided to provide for different cutting patterns, and the templates may be provided with interior and exterior cutting peripheries to provide a plurality of guide paths for the blade cartridges on a single template.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A guided cutting system comprising:

a blade cartridge including a generally cylindrical head portion and a generally cylindrical cover portion;

said head portion having a side wall extending between a cutting end and an opposing non-use end of said head portion, and said head portion including a pair of diametrically opposed gripping portions, each gripping portion comprising a pair of radially extending side surfaces and a gripping surface spaced radially from said side wall of said head portion;

guide means extending from said cutting end for engaging with and following a cutting template to facilitate guiding said blade cartridge in a predetermined pattern;

a cutting blade extending from said cutting end and located in spaced relation to said guide means;

said cover portion comprising a side wall extending between a peripheral edge and an end wall, said peripheral edge and said end wall defining an open end and a closed end, respectively;

said side wall of said cover portion including an inner surface dimensioned for receiving and engaging said side wall of said head portion, and said side wall of said cover portion including a pair of diametrically opposed channels extending axially from said peripheral edge toward said end wall, each of said channels defined by a pair of side edges spaced apart a distance substantially equal to the distance between said radially extending side surfaces on each of said gripping portions;

wherein said cover portion is mountable to said head portion in a first, use position with said inner surface engaging said side wall of said head portion and said end wall covering said non-use end of said head portion, and a second, non-use position with said inner surface engaging said side wall of said head portion and said end wall covering said cutting end of said head portion, and wherein, in both of said first and second positions, said gripping surfaces of said gripping portions and an outer surface of said cover portion, adjacent said channels, define a substantially contiguous surface extending circumferentially around said blade cartridge.

2. The cutting system of claim 1 including locking members located on said head portion and said cover portion for detachably locking said cover portion in said first position and said second position.

3. The cutting system of claim 2 wherein said locking members comprise cooperating tabs and recesses.

4. The cutting system of claim 1 including end surfaces at opposing ends of said gripping portions adjacent said cutting end and said non-use end of said head portion, and said channels in said cover portion each including an inner edge located distal from said peripheral edge, each said inner edge engaging an end surface when said cover portion is in said first and second positions on said head portion.

5. The cutting system of claim 1 including a template defining a pattern to be cut, said template including a groove for receiving said guide means.

6. The cutting system of claim 5 wherein said template includes an outer peripheral edge and said groove is located adjacent to said outer peripheral edge, and including an open interior area defined by an inner peripheral edge of said template located within said outer peripheral edge, and a second groove located adjacent to said inner peripheral edge for receiving said guide means to guide said blade cartridge along a predetermined path within said open interior area.

7. The cutting system of claim 5 wherein said blade cartridge comprises a first blade cartridge, and including a second blade cartridge having the same elements as those recited for said first blade cartridge and wherein a distance between the guide means and the cutting blade of said second blade cartridge is greater than a corresponding distance between the guide means and the cutting blade of said first blade cartridge.

8. The cutting system of claim 1 wherein said end wall of said cover portion comprises a pair of grooves spaced apart a distance corresponding to the spacing between said guide means and said cutting blade.

9. The cutting system of claim 8 wherein said grooves comprise elongated grooves.

* * * * *